US008292615B2

(12) United States Patent
Spangelo et al.

(10) Patent No.: US 8,292,615 B2
(45) Date of Patent: Oct. 23, 2012

(54) SINGLE STAGE GASEOUS FUEL BURNER WITH LOW NOX EMISSIONS

(75) Inventors: Øystein Spangelo, Trondheim (NO); Otto Kristian Sonju, Trondheim (NO); Torbjorn Slungaard, Stjordal (NO); Mario Ditaranto, Trondheim (NO)

(73) Assignee: Norwegian University of Science and Technology (NTNU), Trondheim (NO)

( * ) Notice: Subject to any disclaimer, the term of this patent is extended or adjusted under 35 U.S.C. 154(b) by 949 days.

(21) Appl. No.: 12/087,468

(22) PCT Filed: Jan. 10, 2007

(86) PCT No.: PCT/NO2007/000007

§ 371 (c)(1),
(2), (4) Date: Dec. 18, 2008

(87) PCT Pub. No.: WO2007/081217

PCT Pub. Date: Jul. 19, 2007

(65) Prior Publication Data

US 2009/0220899 A1 Sep. 3, 2009

(30) Foreign Application Priority Data

Jan. 11, 2006 (NO) ..... 20060170

(51) Int. Cl.
*F23C 7/00* (2006.01)

(52) U.S. Cl. ..... 431/187; 431/198; 431/247; 431/248; 431/8; 431/12; 431/159; 431/284; 431/354; 239/418; 239/419; 239/423; 239/424; 239/424.5; 239/434.5

(58) Field of Classification Search ..... 431/8, 10, 431/12, 159, 187, 350, 354, 9, 115, 116, 431/160–165, 181, 195, 278, 284, 285, 349, 431/355, 198, 247, 248; 60/742, 749, 750; 239/418, 419, 421, 423, 424, 424.5, 425, 239/426, 427, 427.3, 429, 431, 432, 433, 239/434, 434.5
See application file for complete search history.

(56) References Cited

U.S. PATENT DOCUMENTS 3,511,587 A * 5/1970 Hilger et al. ..... 431/160
(Continued)

FOREIGN PATENT DOCUMENTS

JP 11-337022 12/1999
(Continued)

OTHER PUBLICATIONS

International Search Report mailed Apr. 18, 2007 for International Application No. PCT/NO2007/000007.

(Continued)

*Primary Examiner* — Kenneth Rinehart
*Assistant Examiner* — Jorge Pereiro
(74) *Attorney, Agent, or Firm* — Wenderoth, Lind & Ponack, L.L.P.

(57) ABSTRACT

A method for burning gas in a burner, including leading the gas through an inner fuel tube and introduction of combustion air through an annular space surrounding the inner fuel tube. This space forms of an outer tube terminated by a conically converging section, wherein the end of the inner fuel tube forms a burner head. The major part of the primary gas is introduced into the upstream end of the burner head, to go into the combustion air that flows past the burner head, whereas a smaller part of a secondary gas is introduced into the free end of the burner head and into the constricted part of the annular channel that surrounds the burner head. The gas flow is accelerated past the burner head due to the reducing cross section and is burned downstream in relation to the burning head.

18 Claims, 5 Drawing Sheets

U.S. PATENT DOCUMENTS

| | | | | | |
|---|---|---|---|---|---|
| 3,773,075 | A | * | 11/1973 | Thompson et al. | 137/890 |
| 3,787,168 | A | * | 1/1974 | Koppang et al. | 431/354 |
| 4,023,921 | A | * | 5/1977 | Anson | 431/9 |
| 4,402,666 | A | * | 9/1983 | Glomm et al. | 431/177 |
| 4,702,691 | A | * | 10/1987 | Ogden | 431/187 |
| 4,725,223 | A | * | 2/1988 | Coppin et al. | 431/243 |
| 4,925,387 | A | | 5/1990 | Locanetto et al. | |
| 5,049,066 | A | | 9/1991 | Kaiya et al. | |
| 5,154,598 | A | * | 10/1992 | Gooderham et al. | 431/188 |
| 5,647,538 | A | * | 7/1997 | Richardson | 239/405 |
| 5,882,184 | A | * | 3/1999 | Feldermann | 431/9 |
| 6,024,083 | A | * | 2/2000 | Smirnov | 126/91 A |
| 6,093,018 | A | * | 7/2000 | Avshalumov | 431/352 |
| 6,461,147 | B1 | | 10/2002 | Sonju et al. | |
| 2002/0197574 | A1 | * | 12/2002 | Jones et al. | 431/8 |
| 2003/0129555 | A1 | * | 7/2003 | Mukai et al. | 431/187 |

FOREIGN PATENT DOCUMENTS

| | | |
|---|---|---|
| JP | 2002-235907 | 8/2002 |
| JP | 2002-364812 | 12/2002 |
| NO | 20011785 | 7/2007 |

OTHER PUBLICATIONS

International Preliminary Report on Patentability mailed Apr. 8, 2007 for International Application No. PCT/NO2007/000007.

* cited by examiner

SINGLE STAGE GASEOUS FUEL BURNER WITH LOW NOX EMISSIONS

BACKGROUND OF THE INVENTION

Field of the Invention

The invention relates to a method for burning gaseous fuel, and a burner having premixing and recirculation, for the combustion of gaseous fuel.

Nitrogen oxides (denoted NOx) consist mainly of NO and NO2 and are a main component in the formation of ground-level ozone, but can also react to form nitrate particles and acid aerosols, which can affect human health by causing respiratory problems. Further, NOx contributes to formation of acid rain and global warming. Consequently, reduction of NOx formation has become a major topic in combustion research.

NOx Formation Mechanisms

Generally, when using a gaseous fuel, the main pollution components are NOx, with NO as the dominating component. NOx in gas combustion is mainly formed by three mechanisms: the thermal NO mechanism, the prompt NO mechanism and the nitrous oxide ($N_2O$) route to NOx. The different mechanisms are affected in different ways by temperature, residence time, oxygen concentration and fuel type. Thermal NO is formed by the following elementary reactions:

$$O+N_2 \rightarrow NO+N \quad (1)$$

$$N+O_2 \rightarrow NO+O \quad (2)$$

$$N+OH \rightarrow NO+H \quad (3)$$

Equation (1) is the rate limiting step and requires high temperatures to give a significant contribution to the total NOx formation because of its high activation energy. From equation (1) to (3) and the assumption that $d[N]/dt \approx 0$ it can be obtained for the NO formation that:

$$\frac{d[NO]}{dt} = 2k_1[O][N_2] \quad (4)$$

where [ ] denotes concentration and $k_1$ is the rate coefficient of the reaction in equation (1). From equation (4) and the temperature dependence of $k_1$, it can be shown that NO formation can be controlled by [O], [$N_2$], temperature and residence time. Thermal NO formation can, therefore, be minimized by reducing peak temperatures, by reducing oxygen levels especially at peak temperatures and by reducing the time of exposure to peak temperatures.

The prompt NO mechanism involves molecular nitrogen from the combustion air reacting with the CH radical, which is an intermediate at the flame front only, forming hydrocyanic acid (HCN), which further reacts to NO:

$$CH+N_2 \rightarrow HCN+N \rightarrow \ldots \rightarrow NO_2 \ldots \rightarrow NO \quad (5)$$

Prompt NO is favored by fuel rich conditions and its formation takes place at lower temperatures (about 1000 K) than thermal NO.

NO formation by the nitrous oxide route increases in importance under conditions such as lean mixtures, high pressure and lower combustion temperatures. This route is important in applications such as gas turbines where such conditions occur.

Techniques for NOx Reduction

NOx formation can be controlled by different known techniques. Most widely used primary measures are external and internal flue gas recirculation, staged combustion and different levels of premixing. External flue gas recirculation and secondary measures such as catalytic conversion and ammonia addition can be expensive, especially on small burners, and can be difficult to install on existing equipment.

Internal flue gas recirculation is achieved when combustion products are recirculated into the unburnt fuel and combustion air mixture by a recirculation flow in the combustion chamber. The recirculated combustion products act both as an ignition source and as an inert gas that reduces the peak temperatures by dilution of the fuel and combustion air mixture. Various geometries and devices can be used to guide the flow to generate such a recirculation flow-field.

Staged combustion is applied by adding fuel and air at different stages of the combustion process. One technique is to start with a fuel rich condition, then adding more air to create an oxygen rich condition. A third stage of adding more fuel can be used before the final equivalence ratio is reached.

Premixing of fuel and air will normally result in too high combustion temperatures at stoichiometric conditions for achieving low emissions of NOx. Partial premixing, however, can, especially in combination with other techniques, give large reductions in NOx emissions.

From U.S. Pat. No. 5,049,066 (Tokyo Gas Company), a low NOx burner is described, which has a conical diverging burner head. The diverging cone is placed within an annulus where combustion air flows and is penetrated by the combustion air flowing through orifices into the cone, to be mixed with gaseous fuel supplied through a central fuel tube. The fuel is injected downstream the cone and is the mixing with combustion air occurs downstream. This is due to the turbulence generated by the air flow through and over the perforated divergent cone.

The mixing of the combustion air with the gaseous fuel inside the cone will not provide satisfactory NOx reduction.

From Norwegian patent application 20011785, a low NOx burner where fuel gas is supplied through an inner fuel tube and combustion air is supplied through a surrounding annulus is known. The outer tube restricting the annular space is terminated in a conical converging section. To provide mixing of the combustion air and the fuel gas, the fuel gas is introduced radially into a mixing zone with radial vanes providing a swirl effect.

SUMMARY OF THE INVENTION

The main object of the invention is to create a single-stage burner for combustion of gaseous fuels with low emissions of nitrogen oxides (NOx) and carbon monoxide (CO) and with high grade flame stability.

The burner should be suitable for burning natural gas (CNG, LPG), methane, butane, propane or mixtures of these and other gaseous fuels.

A further object is to provide a burner of simple design and with only minor adjustments or individual adapting to fit for a particular purpose. Otherwise expressed, the novel burner should maintain low emissions and stability over a broad range of fuel gas and varying power output and excess oxygen.

The invention provides the conditions favourable to the prevention of NOx formation with an appropriate design of the structure itself.

Primary fuel gas is injected into the combustion air and mixed very well by the turbulent flow while passing over the burner head where the flow-area cross section is decreased while flowing downstream. The reduction in cross section has the effect of accelerating the flow.

Secondary fuel is supplied creating a flame stabilization zone in front of the burner head. The flame stabilization zone allows the main mixture of primary fuel and combustion air flowing at high velocity to be stably anchored at the burner. The high velocity of the main premixed gas mixture is unfavourable to NOx formation since the residence time in the hot zones is reduced and the equivalence ratio is such as to avoid high gas temperatures.

In the space formed inside the main annular flame and in front of the burner head, combustion products recirculate and provide further stabilisation to the overall flame, while minimizing the formation of NOx.

The most important characteristics of the burner in accordance with the invention are:

- Low concentrations of nitrogen oxides (NOx) in the exhaust gases
- High burning efficiency
- High flame stability at various conditions
- No need for premixing of fuel and air, and hence safe operation
- Wide turn down ratio Details about the invention, including physical details of the burner, will be described more extensively in the following examples with reference to the drawings.

BRIEF DESCRIPTION OF THE DRAWINGS

The invention is described in the following examples referring to the drawings, in which.

DETAILED DESCRIPTION OF THE INVENTION

Figure 1:
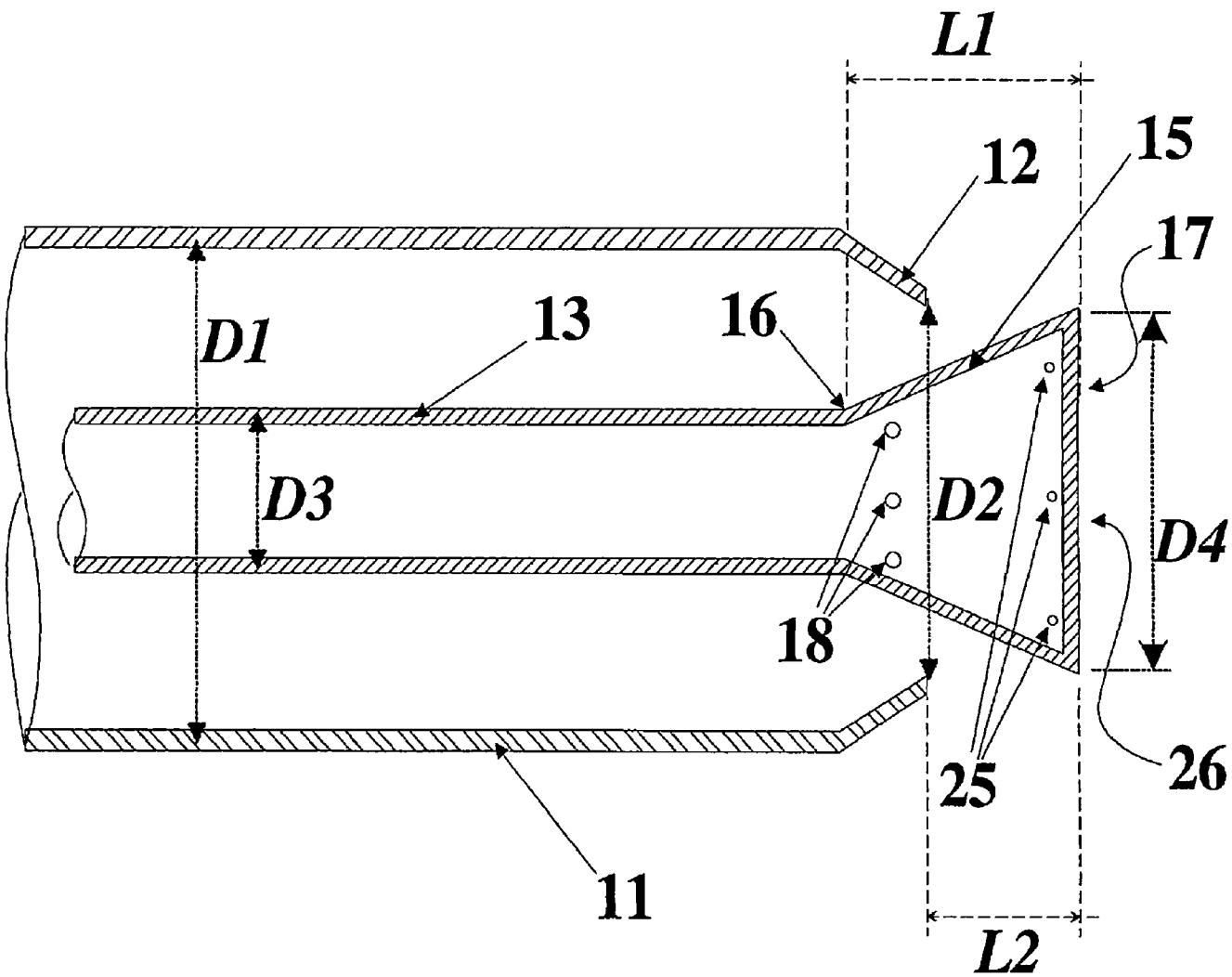
FIG. 1 shows an axial cross-section of an embodiment of the invention showing the general flow streamlines.
Figure 2:
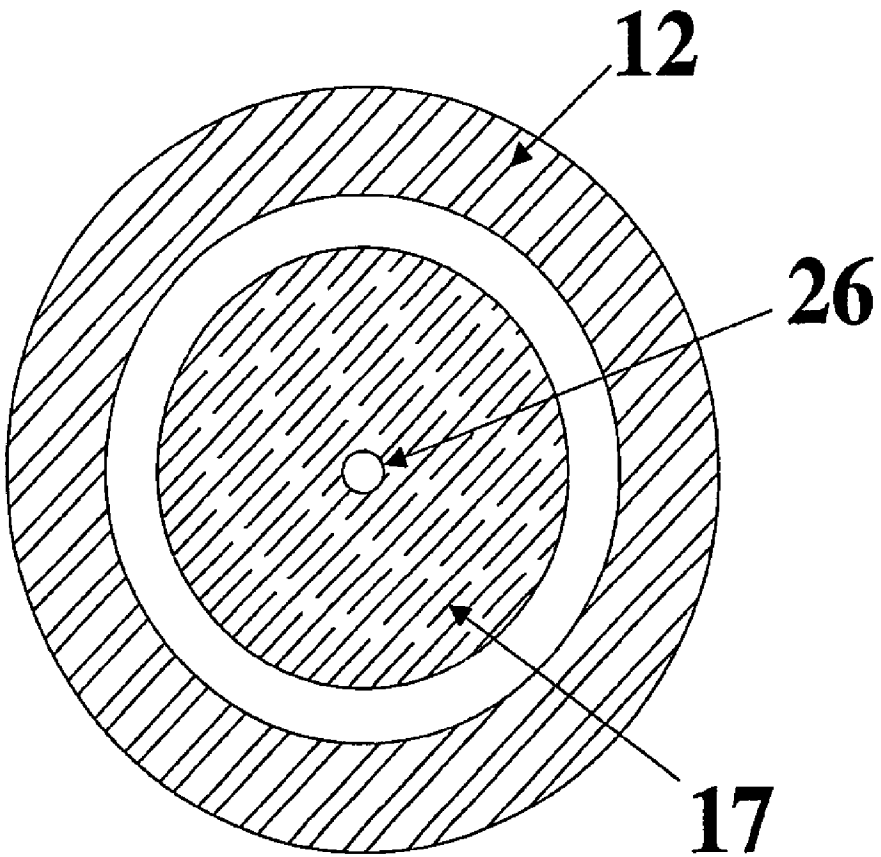
FIG. 2 shows a front-view of the embodiment in FIG. 1.
Figure 3:
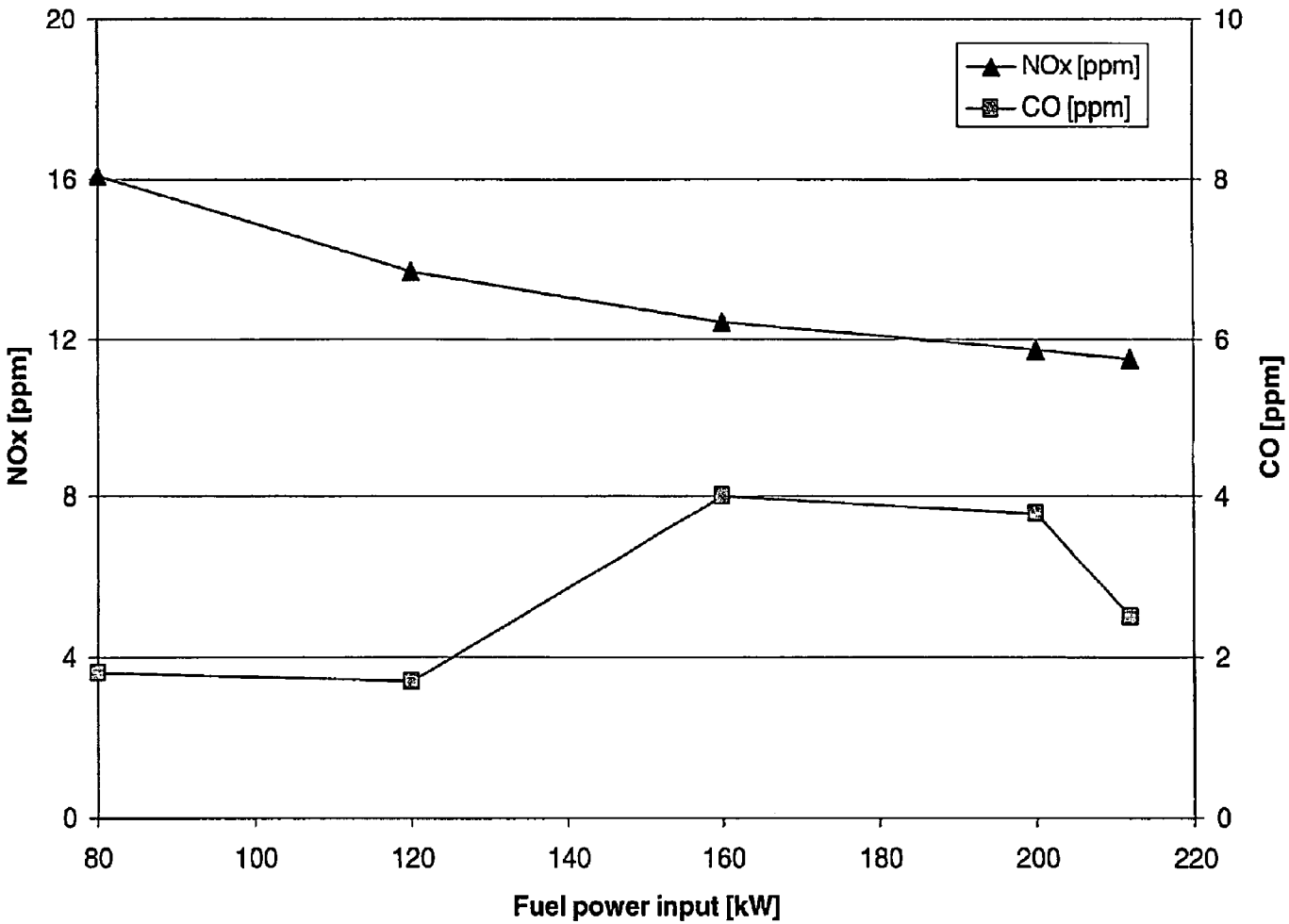
FIG. 3 shows a diagram for NOx and CO measured from the burner configuration described in example 1 in CEN tube no. 4 using propane as fuel.

The burner of the FIGS. 1 and 2 has an outer tube 11 wherein combustion air is supplied from the left in FIG. 1. The combustion air can be supplied either from an air blowing fan, from a compressor or by other means. The outer tube is terminated in a conical converging section 12 which can have an opening diameter D2 of about 75% of the outer tube diameter D1.

Within the outer tube 11, an inner gaseous fuel tube 13 is arranged concentrically such that an annular space is restricted by the outer tube 11 and the inner gaseous fuel tube 13. At the outlet end of the inner gaseous fuel tube 13, a conical burner head 15 is arranged. The conical burner head 15 is diverging from the joint 16 at the end of the inner gaseous fuel tube 13, towards a downstream end where it is sealed by a cover plate 17. The burner head 15 can be integrated with the inner gaseous fuel tube 13 or joined to this tube, e.g. by welding, at the joint 16.

The burner head 15 is diverging with a half angle of 10° to 30°, preferably about 22°. Near the joint 16, the burner head 15 has a row of orifices 18 which are arranged at the circumference of the burner head 15. Primary gaseous fuel (fuel gas) is supplied through these orifices and is mixed into the surrounding combustion air flow. The primary gas is mixed into the combustion air due to turbulence generated when the air and gas mixture is accelerated over the restriction represented by the burner head 15.

At the wide end of the burner head 15, a second row of orifices 25 is arranged at the circumference. Through these orifices, secondary fuel gas is supplied into the surrounding fuel gas and combustion air mixture. The main purpose of introducing the secondary gas is to establish a pilot flame ensuring a continuous ignition of the premixed air and primary gas mixture.

Further effects of introducing secondary fuel gas at the outer end of the burner head 15 are to allow staging the total required amount of gaseous fuel. In so doing, the premixed stream of air burning in the main combustion zone is fuel lean, which is beneficial to achieve low NOx formation, as described above.

Alternatively or in addition, one orifice 26 at the centre of the cover plate 17 can be used.

The secondary injection of gaseous fuel through orifices 25 (alternatively 26) will enrich locally the flow of combustion air and primary introduced gaseous fuel, providing stabilisation of the flame in front of the burner head 15.

EXAMPLE 1

The burner configuration described in this example has been applied for propane as gaseous fuel. In this example, eight primary orifices 18 with a diameter of 3 mm are arranged in a circular row around the circumference of the narrow beginning 16) of the burner head 15. The outer tube 11 diameter D1 is 100 mm and the conical converging section 12 has a minimum diameter D2 of 75 mm. The inner gaseous fuel tube 13 has an outer diameter D3 of 30 mm, while the burner head 15 has a maximum diameter D4 of 70 mm and a length L1 of 50 mm. The burner head 15 is positioned in such a way that the distance L2 from the end of the conical converging section 12 to the end of the burner head 15 is 25 mm.

EXAMPLE 2

The burner configuration described in this example has been applied for natural gas (82.35% methane, 13.83% ethane, 1.10% butane, 1.13% nitrogen, 1.49% carbon monoxide and 0.10% heavier hydrocarbons) as gaseous fuel. The burner configuration is as described above, but some dimensions have been changed.

In this example, eight primary orifices 18 with a diameter of 4 mm are arranged in a circular row around the circumference of the narrow beginning 16 of the burner head 15. The outer tube 11 diameter D1 is 100 mm and the conical converging section 12 has a minimum diameter D2 of 75 mm. The inner gaseous fuel tube 13 has an outer diameter D3 of 30 mm, while the burner head 15 has a maximum diameter D4 of 70 mm and a length L1 of 50 mm. The burner head 15 is positioned in such a way that the distance L2 from the end of the conical converging section 12 to the end of the burner head 15 is 32 mm.

EXAMPLE 3

The burner configuration described in this example has been applied for propane as gaseous fuel. The burner configuration is as described above, but the dimensions have been changed.

In this example, eight primary orifices 18 with a diameter of 4.1 mm are arranged in a circular row around the circumference of the narrow beginning 16 of the burner head 15. The outer tube 11 diameter D1 is 136 mm and the conical converging section 12 has a minimum diameter D2 of 102 mm. The inner gaseous fuel tube 13 has an outer diameter D3 of 42 mm, while the burner head 15 has a maximum diameter D4 of 96 mm and a length L1 of 68 mm. The burner head 15 is positioned in such a way that the distance L2 from the end of the conical converging section 12 to the end of the burner head 15 is 34 mm.

Figure 4:
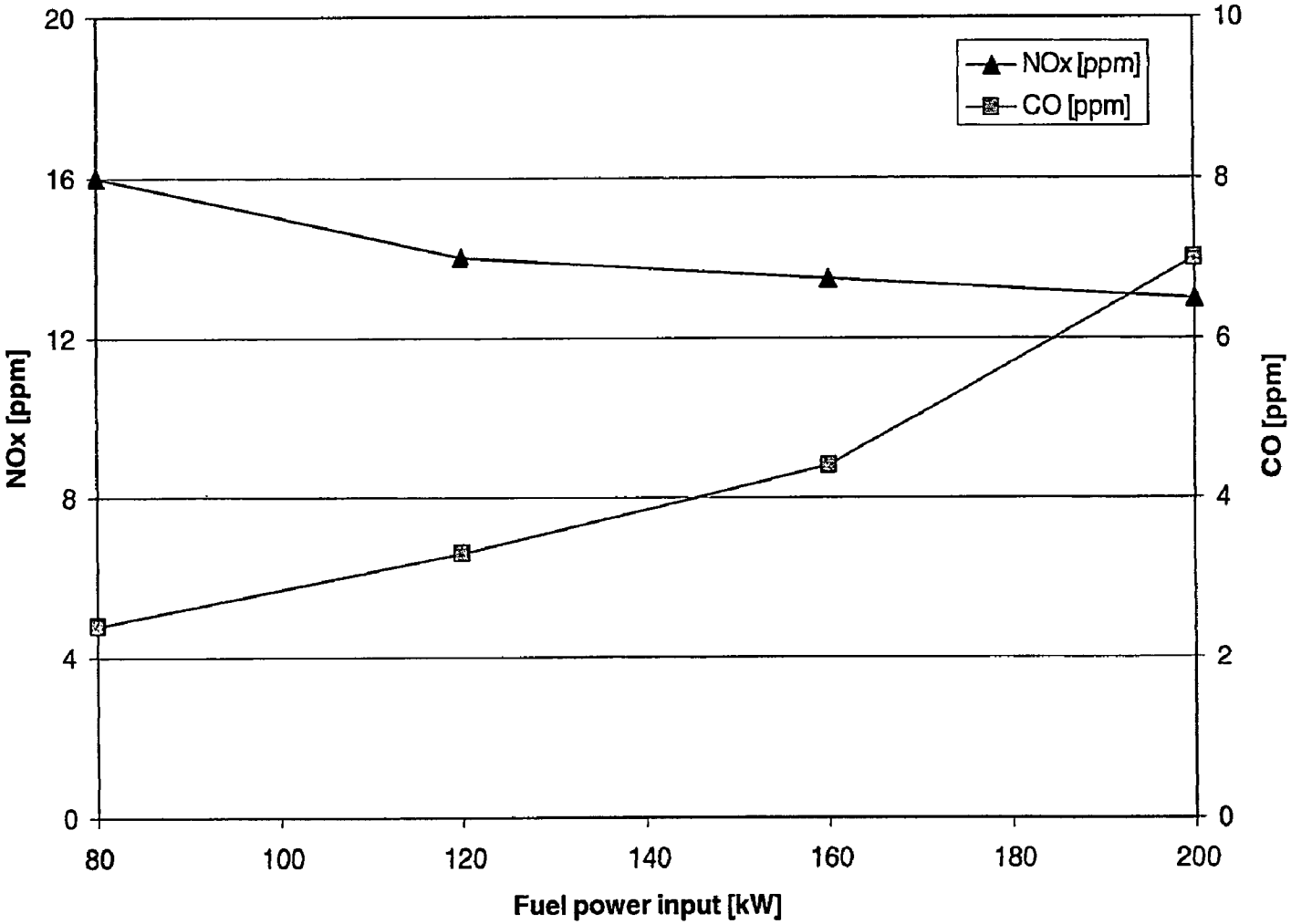
FIG. 4 shows a diagram for NOx and CO measured from the burner configuration described in example 2 in CEN tube no. 4 using natural gas as fuel.
Figure 5:
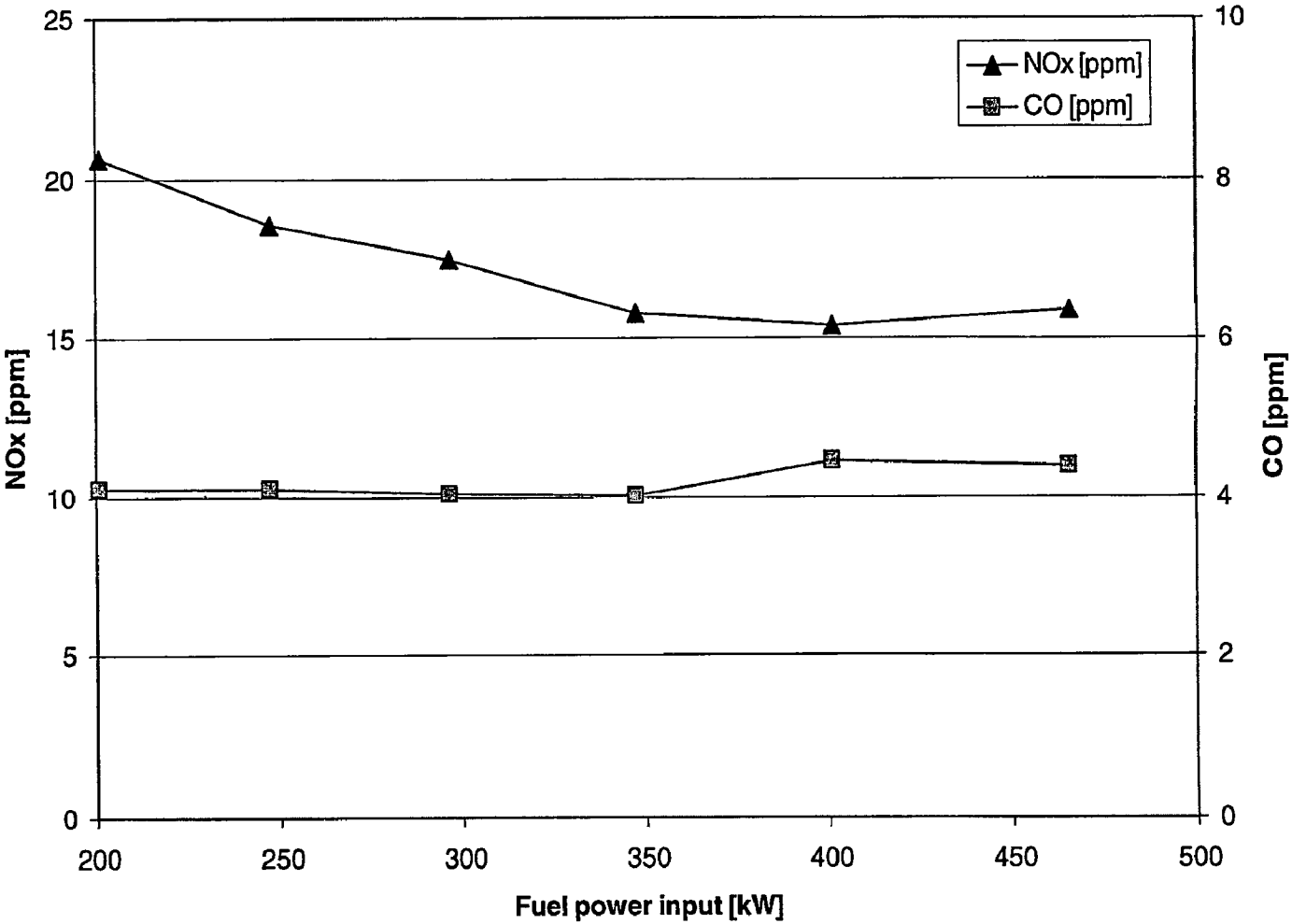
FIG. 5 shows a diagram for NOx and CO measured from the burner configuration described in example 3 in a vertical downdraught boiler using propane as fuel.

These dimensions from examples 1 to 3 are summarized in Table 1. Emissions of NOx and CO measured from the burners described in example 1 to 3 is shown in FIGS. 4 to 6, respectively.

TABLE 1

Example dimensions summarized

| | Example 1 | Example 2 | Example 3 |
|---|---|---|---|
| Primary gas orifices (18) | 8 × Ø3 mm | 8 × Ø4 mm | 8 × Ø4.1 mm |
| D1 | 100 mm | 100 mm | 136 |
| D2 | 75 mm | 75 mm | 102 mm |
| D3 | 30 mm | 30 mm | 42 mm |
| D4 | 70 mm | 70 mm | 96 mm |
| L1 | 50 mm | 50 mm | 68 mm |
| L2 | 25 mm | 32 mm | 34 mm |
| Fuel | Propane | Natural gas[(1)] | Propane |

[(1)]Natural gas consisting of 82.35% methane, 13.83% ethane, 1.10% butane, 1.13% nitrogen, 1.49% carbon monoxide and 0.10% heavier hydrocarbons.

The burner can optionally be fitted with ignition probes and an ionization probe flame detector or other flame controlling equipment.

A burner as described in the first example above has been tested in a CEN tube with fuel power input in the range 80-200 kW using both methane and propane as fuel gas. Emissions of NOx has been measured in the range 10-20 parts per million while emissions of CO was measured below 10 parts per million.

The invention claimed is:

1. A burner for burning non-premixed gaseous fuel and air with low NOx emissions, said burner comprising:

an outer tube configured to supply combustion air, and being terminated by a conically converging section;

an inner gaseous fuel tube configured to supply gaseous fuel gas to the combustion, and being positioned concentrically inside the outer tube; and a burner head disposed at the end of the inner gaseous fuel tube, and having a conical part, the burner head being a downstream diverging cone, wherein the conical part of the burner head has a series of circumferentially arranged primary orifices through which a major portion of the gaseous fuel is capable of exiting into an annular space between the outer tube and an upstream end of the burner head, the burner head also having a secondary inlet for gaseous fuel at a free end of the conical part, the secondary inlet configured to introduce a minor part of the gaseous fuel to the burning zone and wherein the burner head protrudes a predetermined distance from an end of the conically converging section of the outer tube.

2. The burner according to claim 1, wherein a series of annular secondary orifices is arranged in the vicinity of the free end of the burner head, from which a minor portion of the gaseous fuel is capable of exiting into the flow of air and primary gaseous fuel passing by the burner head.

3. A burner according to claim 2, wherein a secondary inlet for gaseous fuel comprises at least one orifice in an end wall of the diverging, conical burner head.

4. A burner according to claim 2, wherein the diverging, conical burner head has a divergent half angle in the range 10° to 30°, to the axis.

5. The burner according to claim 2, wherein the diverging, conical burner head has a divergent half angle of 22° to the axis.

6. The burner according to claim 1, wherein the secondary inlet for gaseous fuel comprises at least one orifice in an end wall of the burner head.

7. The burner according to claim 6, wherein the diverging, conical burner head has a divergent half angle in the range 10° to 30°, to the axis.

8. The burner according to claim 6, wherein the diverging, conical burner head has a divergent half angle of 22° to the axis.

9. The burner according to claim 1, wherein the burner head has a divergent half angle in the range from 10° to 30°, relative to a longitudinal axis.

10. The burner according to claim 1, wherein the diverging, conical burner head has a divergent half angle of 22° to the axis.

11. The burner according to claim 1, wherein the burner is configured such that air flow in the annular space between the outer tube and an upstream end of the burner head is an annular accelerating air flow.

12. The burner according to claim 11, wherein the burner head is arranged such that the gaseous fuel is capable of being injected as cross jets into the annular accelerating air flow between the conical converging section of the outer tube and the conical part of the burner head.

13. A method for burning gaseous fuel in a burner, said method comprising:

introducing gaseous fuel through an inner gaseous fuel tube, and introducing a combustion air flow through an annular space surrounding the inner gaseous fuel tube, the annular space being formed by an outer tube terminating in a conical converging section at end of the outer tube, the inner gaseous fuel tube, and a diverging, conical burner head formed as a downstream diverging cone disposed at an end of the inner gaseous fuel tube wherein the diverging, conical burner head protrudes a predetermined distance from an end of the conically converging section of the outer tube, said method further comprising introducing a major part of primary gas at an upstream end of the diverging, conical burner head, in a restricted part of the annular space surrounding the diverging, conical burner head for injecting gas into the combustion air flow surrounding the diverging, conical burner head;

introducing a minor part of secondary gas at a free end of the diverging, conical burner head, to generate a mixed flow of air and gaseous fuel mainly originating from the annular space formed by the inner and outer tubes;

accelerating the mixed flow of air and gaseous fuel from a beginning section of the diverging, conical burner head due to a progressively reduced cross section formed by the diverging, conical burner head and the conical converging section at the end of the outer tube and thereby providing adequate properties for burning the mixed flow of air and gaseous fuel downstream to avoid formation of NOx while ensuring complete combustion.

14. The method according to claim 13, wherein the minor part of secondary gas is introduced through an annular series of orifices at the free end of the diverging, conical burner head so that the gaseous fuel and air are not completely mixed prior to an open end of the burner, and unwanted propagation of a flame inside the burner is prevented.

15. The method according to claim 13, wherein the minor part of secondary gas is introduced through at least one axial orifice at the free end of the diverging, conical burner head.

16. The method according to claim 15, further including:

creating a flame stabilization zone in front of the diverging, conical burner head, enabling a main portion of the mixed flow of air and gaseous fuel flowing at high velocity to be stably anchored at the burner; and recirculating combustion products and providing further stabilization to an overall flame in a space formed inside a main annular flame and in front of the diverging, conical burner head, while minimizing the formation of NOx.

17. The method according to claim 13, further comprising burning a first portion of the gaseous fuel in a recirculating flow at the free end of the diverging, conical burner head, and a second portion in an annular flow surrounding the recirculating flow.

18. The method according to claim 13, wherein the gaseous fuel and air are not completely mixed prior to an open end of the burner, so that unwanted propagation of a flame inside the burner is prevented.

* * * * *